United States Patent [19]

Ward et al.

[11] Patent Number: 4,688,538

[45] Date of Patent: Aug. 25, 1987

[54] RAPID PULSED MULTIPLE PULSE IGNITION AND HIGH EFFICIENCY POWER INVERTER WITH CONTROLLED OUTPUT CHARACTERISTICS

[75] Inventors: Michael A. V. Ward, Lexington; Robert P. Lefevre, North Andover, both of Mass.

[73] Assignee: Combustion Electromagnetics, Inc., Arlington, Mass.

[21] Appl. No.: 688,036

[22] Filed: Dec. 31, 1984

[51] Int. Cl.[4] ..... F02P 3/08; F02P 7/077

[52] U.S. Cl. ..... 123/598; 123/618; 123/637

[58] Field of Search ..... 123/606, 637, 597, 598, 123/618

[56] References Cited

U.S. PATENT DOCUMENTS

| | | | |
|---|---|---|---|
| 3,736,463 | 5/1973 | Basso et al. | 123/645 X |
| 3,898,971 | 8/1975 | Lefevre | 123/598 |
| 4,131,100 | 12/1978 | Merrick | 123/598 |
| 4,502,454 | 3/1985 | Hamai et al. | 123/634 X |

*Primary Examiner*—Tony M. Argenbright
*Attorney, Agent, or Firm*—Jerry Cohen

[57] ABSTRACT

A versatile rapid pulsing multiple pulse ignition controller (17) used in conjunction with an converter power supply (13) with a voltage sensor/controller (16) and with an ignition coil (3) and energy capacitor (4) comprising an ignition system providing rapid firing multiple ignition sparks at high converter power supply efficiency; which ignition system is suitable for installation on existing automobile engines and other internal combustion engines including diesel engines. The ignition is powered by an converter (13) working as a gated oscillator driving a power amplifier which is turned off by voltage level sensor/controller (16) when the converter output (14*a*) reaches a preset value or ground potential, as when an ignition pulse is occurring, giving converter (13) the highest possible efficiency and minimum power dissipation. Controlled ignition firing and multiple pulsing is provided by a multiple pulse controller (17) connected to breaker points or other electronic trigger (18). The ignition controller (17) includes a universal input trigger converter (19) for detecting and shaping the input trigger and providing the initial timing trigger for the spark pulse, a gate pulse width control (20) for providing the pulse train width and varying it with RPM, and a gated clock oscillator (21) for providing the pulse rate. When multiple pulse controller (17) is used in conjunction with power converter (13), voltage sensor (16), and an ignition coil (3) and capacitor (4), a practical, easily installed, low cost, ultra-high efficiency "rapid pulsing" ignition system is provided, capable of producing ignition of lean mixtures for substantially reduced exhaust emissions and increased engine efficiency.

10 Claims, 3 Drawing Figures

RAPID PULSED MULTIPLE PULSE IGNITION AND HIGH EFFICIENCY POWER INVERTER WITH CONTROLLED OUTPUT CHARACTERISTICS

CROSS REFERENCE TO RELATED APPLICATION AND PATENT

This application is related to the copending application of Ward filed on even date date herewith and commonly assigned, Ser. No. 688,030.

BACKGROUND OF THE INVENTION AND PRIOR ART

The present invention comprises an optimal spark ignition system based on an optimally designed, versatile, ultra-high efficiency, high energy, high pulse rate, multi-pulse capacitive discharge (CD) electronic ignition system.

The purpose of the system, designated as Rapid Pulsed Multi-Pulse Ignition, or Rapid Pulsed Ignition (RPI) for short, is to provide an easily incorporated and retrofitable ignition which will allow internal combustion engines to operate under lean air-fuel ratio mixture conditions through rapid firing multiple pulse ignition for high engine efficiency and low exhaust emissions. For the case of Diesel engines (Direct Injection (DI) engines) the system provides effective ignition of the fuel for reduced ignition delay time and more controlled combustion by providing many ignition sites during the short fuel injection period.

Current ignition and combustion related equipment are either ineffective or impractical for allowing engines to operate at the 22:1 air-fuel ratio necessary to meet the presently contemplated moderately strict European emission standards. In the U.S. for example, where emission standards have been in force for many years, the rich mixture (14.6:1 air-fuel ratio) three-way catalyst system is exclusively used for gasoline engines.

The conventional Kettering (inductive) ignition system is totally ineffective in providing ignition of mixtures leaner than about 18:1. Electronic ignition and Capacitive Discharge (CD) ignition are no better as they use the same extremely inefficient ignition coil and provide minimal ignition energy (electrical currents) to the spark. Conventional multiple pulse ignition systems such as U.S. Pat. No. 3,898,971 are superior to these, but suffer from having a low pulse rate and a low converter power supply efficiency and provide only slightly better lean mixture ignition properties. The typical time between pulses in an ignition burst or train is one to two milliseconds, representing a low pulse rate and low pulse duty cycle. This pulse rate is too low to be useful at anything but low RPM, and of marginal use in Direct Injection (DI) engines where the typical fuel injection time is one to two milliseconds.

Other systems fail to address and answer the fundamental questions of providing successful ignition by tailoring the pulsing characteristics for optimal ignition ability and for providing a high efficiency converter power supply to drive the capacitive discharge ignition system.

OBJECTS OF THE INVENTIONS

It is the object of this invention to provide a versatile, simple, high efficiency, high pulse rate multiple pulse ignition circuit invention for use in conjunction with a capacitor and ignition coil to produce an overall ignition system which is optimized with respect to pulse rate and pulse width, and which is overall simple and practical, and exhibits a high power supply operating efficiency.

Another object of the invention is to provide these optimal ignition system characteristics in a simple, easily incorporated and retrofitable system, composed of a supply/control box usable with any ignition coil.

Another object is to provide rapid firing pulses with a time between pulses selectable down to zero milliseconds (continuous pulsing) and a high pulsing duty cycle up to 100%, where pulsing duty cycle equals ignition pulse period divided by sum of the pulse period and no pulse period.

Another object is to provide both universal ignition triggering means so that the ignition can be triggered from a variety of ignition trigger devices and simple OEM triggering means.

Another object is provide an converter power supply working as a gated oscillator driving a power amplifier capable of being turned off between ignition firings after recharged of the energy storage capacitor to a voltage specified by a regulator circuit, and during the actual ignition pulses in order to reduce converter power dissipation, to avoid SCR latching, and attain the highest possible power supply efficiency.

Another object is to provide a number of pulses per ignition which decreases with increasing engine speed and increases with decreasing input power supply voltage (as under engine cranking conditions).

Other features and advantages will be pointed out hereinafter, and will become apparent from the following discussion including a Summary of the invention and Description of Particular Preferred Embodiments of the invention when read in conjunction with the accompanying drawings.

SUMMARY OF THE INVENTION

This invention comprises a novel, simple design, versatile, high efficiency, high pulse rate and high duty cycle multiple pulse capacitive discharge ignition system which provides the capability for both optimized ignition spark pulsing characteristics and converter power supply operation.

The invention features several ignition pulses per firing at a high pulse rate of several pulses per millisecond, a duty cycle in the range of 20% to 60%, and a pulse oscillation frequency as high as 10–30 KiloHertz, depending on the coil used. The invention also incorporates certain control features which allow it to operate at a very high efficiency, including: power supply turn-off between firings; output voltage sensing and feedback to closely regulate output voltage (and optimize power supply efficiency and coil design); and variation (reduction) of number of pulses per ignition with engine speed, compensating in part for the increased number of ignition firings with engine speed.

The invention also features circuitry which allows it to be triggered from a variety of sources (including mechanical ignition points and electronic signals) and features particularly simple circuitry to generate the pulse train with a decreasing number of pulses with engine speed.

When this optimized regulated power supply and control box is coupled with an ignition coil and capacitor, one obtains an ignition (Rapid Pulsed Ignition) system with a high efficiency, an improved ignition ability, and which is easily retrofitable on existing automobile engines. Its igniting ability is superior to existing ignitions, and used in conjunction with a high efficiency coil, it will allow an automobile engine to operate at the 22:1 air-fuel (AF) ratio necessary to meet contemplated European emission standards and provide twenty to thirty percent efficiency improvement over three-way catalyst engines (through its lean combustion operation).

BRIEF DESCRIPTION OF THE DRAWINGS

The nature and objects of the invention are illustrated and described with reference to the following drawings, which also illustrate the preferred embodiments of the invention.

DESCRIPTION OF THE PREFERRED EMBODIMENTS

Figure 1:
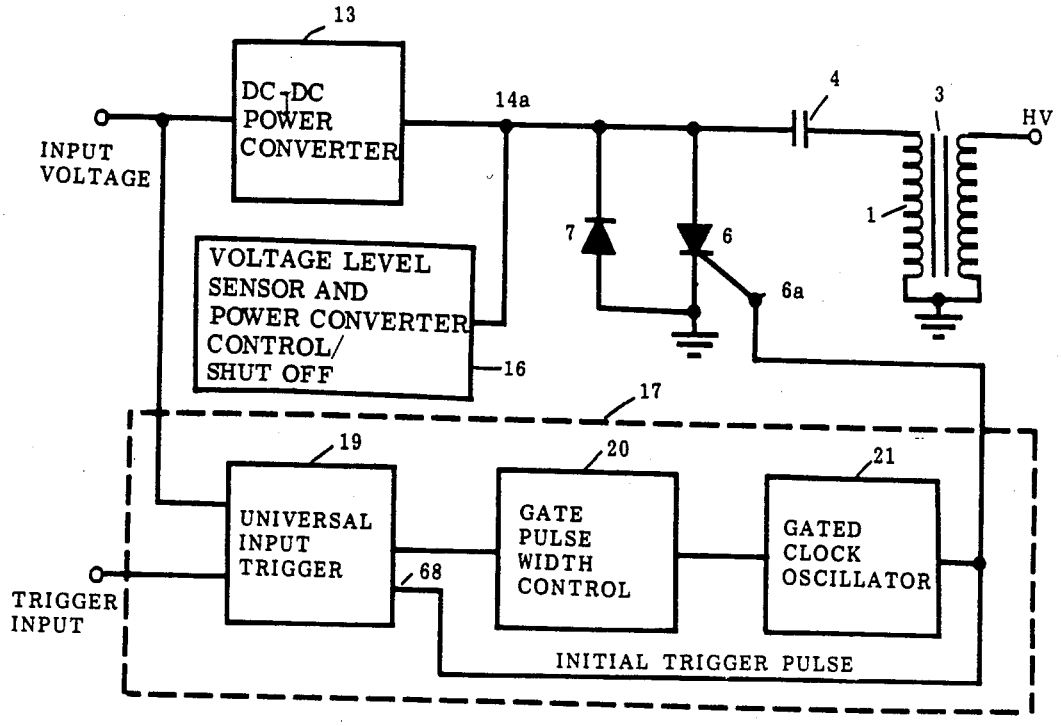
FIG. 1 is a schematic block diagram of the invention shown in its preferred embodiment of a capacitive discharge ignition system.

FIG. 1 depicts the Rapid Pulsed Ignition invention used in the preferred capacitive discharge ignition embodiment including a gated power converter 13 for charging ignition capacitor 4 which is in series with ignition coil 3. SCR switching element 6 is closed by trigger pulse received from trigger generator circuit 17 at input 6*a* to complete the series circuit between the ignition capacitor 4 and ignition coil primary winding 1 by a signal provided from initial timing pulse trigger junction 68 (in the universal trigger circuit 19) and gate clock oscillator 21. Oscillator 21 is responsive to the gate pulse width control circuit 20 enabling the clock 21 during the period of time width control 20 is in a high active state. Width control 20 is responsive to the universal input trigger converter 19 which conditions and shapes the signal from the ignition trigger synchronizing means 18 which may be either mechanical breaker contacts or the output of current O.E.M. electronic ignition or any similar single positive trigger ignition timing means.

Voltage sensor 16 turns off the gated power converter 13 when the voltage at 14*a* reaches 380 volts or other preset value, and also turns off gated power converter 13 during the period of time when SCR 6 and diode 7 conduct discharge ignition capacitor 4 into ignition coil primary winding 1. Power converter 13 and gated clock oscillator 21 are based on U.S. Pat. No. 3,898,971, which has been assigned to the present assignee.

Figure 2:
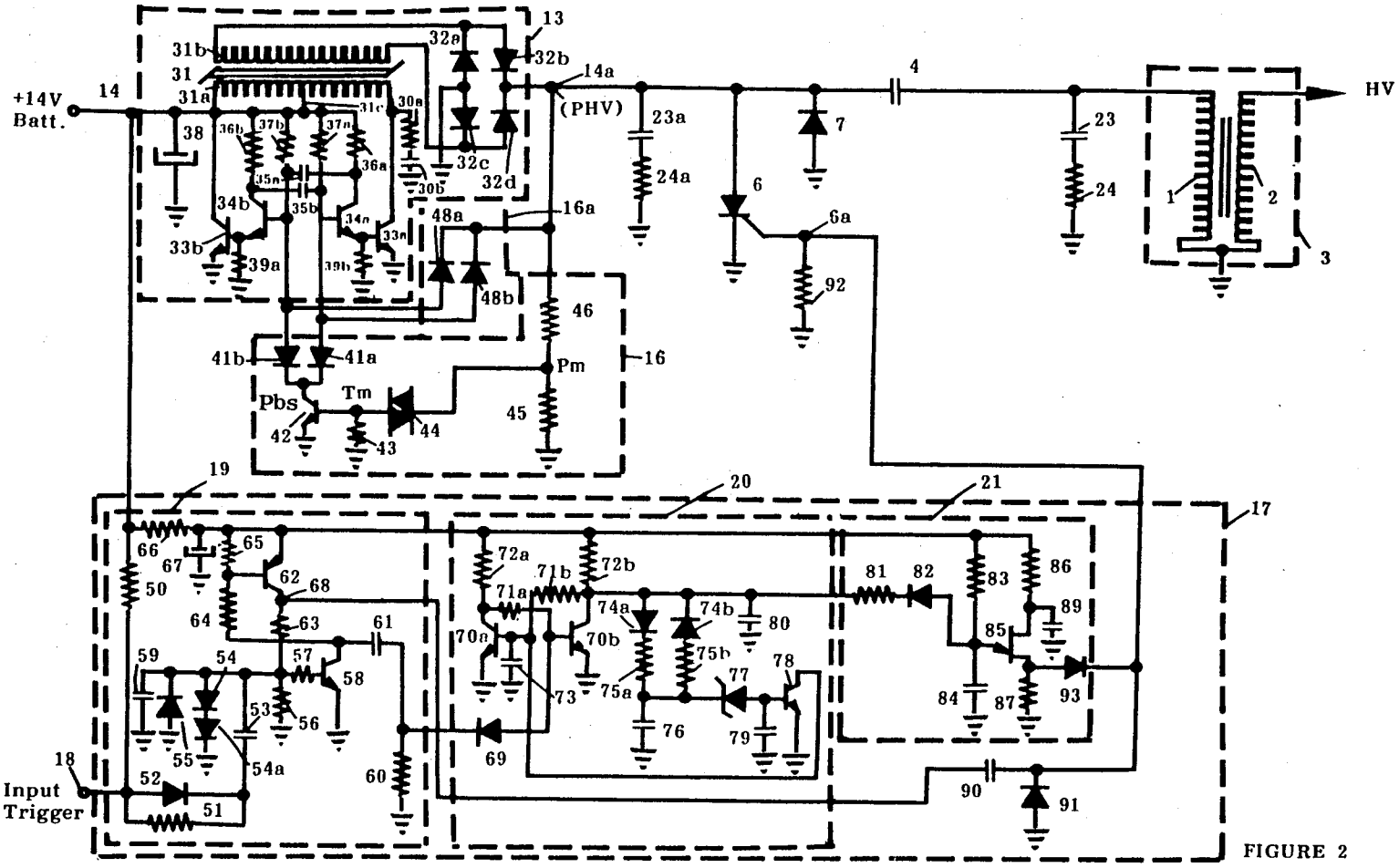
FIG. 2 is a detailed drawing of the preferred embodiment of the invention.

FIG. 2 depicts one specific embodiment of the invention including gated power supply converter 13 similar to that of U.S. Pat. No. 3,898,971. Converter 13 includes an astable multivibrator including transistors 34*a*, 34*b*, resistors 36*a*, 36*b*, 37*a* and 37*b*, and capacitors 35*a* and 35*b*, which determine the multivibrator frequency and transistor biases. The multivibrator drives power converter switching amplifier circuit including power darlington transistors 33*a* and 33*b* which are connected in series with the primary 31*a* of set-up transformer 31. A positive voltage at point 14 is supplied to transformer 31 center tap 31*c* via 14 and power supply filtering is provided by capacitor 38. Snubber filter made up of resistor 30*a* and capacitor 30*b* damp out oscillations occurring at turn off of the multivibrator. The secondary winding 31*b* of transformer 31 is connected across a full wave diode bridge rectifier (DB) which includes four fast recovery diodes 32*a*, 32*b*, 32*c* and 32*d*. The rectified output 14*a* (point PHV) is used to charge capacitor 4 through the ignition coil primary winding 1 of coil 3 with filter components capacitor 23*a*/resistor 24*a* forming a snubber circuit to minimize the dv/dt effect on SCR 6 preventing its false triggering from the rapid rise in voltage at point 14*a* during power converter 13 restart cycle. Power supply converter 13 is controlled by voltage level sensor 16 which shuts off power converter 13 when output voltage 14*a* has reached 380 volts or other preset valve. Sensor 16 includes a spark firing gate sensor 16*a* which also shuts off converter 13 when point 14*a* is pulled to ground (about 2.0 volts from ground) through SCR 6 firing. This is possible because series transistors 34*a*/33*a* (and 34*b*/33*b*) provide three diode drops as one of the two transistors is chosen to be a darlington. Transistors 34*a* and 34*b* could be darlington type instead (with two diode drops).

In operation the gate power converter astable multivibrator 13 produces a signal of approximately 12 KHz, which after transformation and rectification provides a charging current to ignition capacitor 4 which is regulated by voltage level sensor 16. Transformer 31 is designed to provide 380 volts at rectifier output 14*a* with an input battery voltage of about 9 volts at 14. This provides the full 380 volts output rectifier voltage 14*a* during engine cranking which is regulated by voltage level sensor 16 at higher battery electrical system voltage once the engine is running.

Voltage level sensor 16 includes a resistive voltage divider network 46 and 45 which supplies a reference voltage Vm to the series combination of diac diode 44 and the parallel combination of base-emitter junction of transistor 42 and resistor 43 (point Tm). When the resistive divider 45/46 reference voltage Vm at point Pm exceeds the sum of the diac diode 44 voltage Vs and transistors 42 base-emitter voltage drops, diac diode 44 conducts supplying base bias current to transistor 42 resulting in the cathodes of gate steering diodes (Dsl) 41*a* and 41*b* (point Pbs) to be pulled down to within 0.1 volts of ground through transistor 42 saturated collector-emitter voltage drop. The resulting voltage drop at the gate diodes anodes 41*a* and 41*b* is approximately 0.7 v which now appears at the base of astable multivibrator transistors 34*a* and 34*b* removing forward bias drive of 2.0 volts required for operation of the astable multivibrator. Such a voltage level sensor 16 in conjunction with power converter 13 allows for substantial variations in voltages at the power supply input 14, during engine cranking for example, maintaining a preset voltage at point 14*a* while increasing converter 13 efficiency.

The second unique feature, the spark firing gate sensor 16*a* senses spark firing which occurs when SCR 6 conducts pulling the cathodes of gate diodes 48*a* and 48*b* to within about 1.4 volts from ground, reslting in a voltage drop of about 2.0 volts at the anodes of gate diodes 48*a* and 48*b*, effectively removing the required operating base bias to astable multivibrator transistor 34*a* and 34*b*. Spark firing gate diodes 48*a* and 48*b* prevent the power supply converter 13 from operating during spark firing, thus preventing SCR latching and raising the total power supply efficiency.

The switching circuit includes SCR 6 with its gate 6*a* connected to the cathode of diode 93 which isolates gate clock oscillator 21 from the initial timing pulse trigger transistor collector 68. The initial pulse is a trigger voltage spike formed by differentiator including capacitor 90, resistor 92 and negative clamp diode 91. The gate clock oscillator 21 is formed by unijunction transistor 85, resistors 83, 86, 87 and capacitor 84 and 89. Gate clock oscillator 21 operates as a relaxation oscillator with a frequency determining RC network 83 and 84. When the capacitor voltage 84 reaches the unijunction transistor 85 gate firing voltage, the UJT conducts driving its junction into a negative resistance region discharging capacitor 84 through load resistor 87 forming a positive short duration pulse which is coupled through isolation diode 93 to SCR gate 6*a* and SCR 6 gate load resistor 92. When capacitor 84 discharge current drops below UJT 85 valley point, the UJT 85 gate-base junction turns-off and the charge cycle repeats for as long as gate clock diode 82 is reverse biased by a high signal level at the collector of transistor 70*b* which is the gate pulse width control 20 output. Capacitor 89 filters out voltage variations at the UJT 85 B2 junction thus providing pulse train duration stability to UJT 85 operation. Resistor 81 in series with gate clock diode 82 establishes an equivalent quiesent voltage at UJT 85 valley point voltage across charge capacitor 84 such that the period between the initial timing pulse is approximately equal to the gate clock oscillator 21 pulse train period.

Gate pulse witdh control 20 generates a rectangular positive going signal with a width duration that is inversely proportional to engine RPM. Width control 20 is formed by bistable multivibrator which includes transistors 70*a* and 70*b*, resistors 71*a*, 71*b*, 72*a* and 72*b*, initializing capacitor 73, steering diode 69, charge RC time constants which include diode 74*a*, resistor 75*a* and capacitor 76, discharge RC which includes diode 74*b*, resistor 75*b* and capacitor 76, threshold trigger zener reference diode 77, transistor switch 78 and capacitor 79. Capacitors 79 and 80 are filter capacitors.

When the ignition switch is turned-on, applying battery voltage to point 14, current initially flows through resistors 72*b*, 71*b* and bistable multivibrator initializing capacitor 73. Capacitor 73 initially appears as a short circuit holding the base of transistor 70*a* low during initial power application initializing a low output at the bistable multivibrator transistor 70*b* collector output which forward biases gate clock diode 82 holding the gate clock oscillator 21 off the gate pulse width control 20 timing capacitor 76 in a discharged state holding the bistable multivibrator reset transistor 70*a* off. When a negative going trigger pulse appears at the cathode of bistable set steering diode 69, the base of transistor 70*b* is pulled negative reverse biasing transistor 70*b* and forward biasing transistor 70*a*, toggling the bistable producing a high output level at transistor 70*b* collector which reverse biases gate clock diode 82 enabling gate clock oscillator UJT 85 into operation producing a train of positive pulses at SCR gate 6*a* for the period of time the bistable output is high. The bistable high output at transistor 70*b* forward biases charge diode 74*a* with current flowing through charge resistor 75*a* charging capacitor 76. When charge capacitor 76 voltage exceeds zener 77 reference voltage and the base-emitter junction voltage of transistor 78, the zener conducts forward biasing bistable reset switch transistor 78 base-emitter junction pulling its collector low which removes the forward bias on transistor 70*a* base-emitter junction thus resetting the bistable output to a low state at transistor 70*b* collector. A low bistable output forward biases discharge diode 74*b* discharging capacitor 76 through discharge resistor 75*b*. The discharge resistor 75*b* is selected to allow charge voltage to remain on capacitor 76. When the next bistable set pulse toggles the bistable to a high output once again, charge capacitor 76 charge time is decreased due to an initial voltage remaining on capacitor 76 reducing capacitor 76 charge time prior to reaching the zener diode 77 reference conduction voltage which enables bistable reset switch transistor 78 and reduces the gate pulse width control 20 output width duration. As the bistable input set pulse frequency increases with engine RPM, the bistable output pulse duration decreases, which reduces the gate clock oscillator operating period, thus reducing the number of pulses in the firing pulse train with increasing engine RPM.

The pulse width control 20 bistable set pulse is obtained from the universal input trigger converter 19 which accepts and shapes input trigger signal to be submitted to bistable set steering diode 69. The input trigger signal synchronizing means at point 18 may be breaker points or the output of electronic ignition. An ignition synchronizing means trigger is defined as a positive rising signal at point 18. In a quiescent state, no ignition trigger, point 18 is at or near ground potential and both transistors 58 and 62 are off, or in a non-conducting state. Transistors 58, 62 and associated components resistors 56, 57, 63, 64, and 65 form a self latching pulse shaping amplifier. Output capacitor 61 and resistor 60 form a differentiator and produces a negative going pulse at the cathode of set steering diode 69 when the collector of transistor 58 switches to a low state or triggered conducting activate state. Series diodes 54 and 54*a* are positive input signal excursion clamp diodes that protect the junction of resistors 56/57/63 from exceeding +1.4 volts to protect transistors 58 input base-emitter junction with base current limiting provided by resistor 57. Diode 55 is a negative signal protecting diode which prevents the base-emitter junction of transistor 58 from exceeding −0.7 volts. Input trigger signal conditioning components include input load resistor 50, output bounce blanking components which includes diode 52, resistor 51 and capacitor 53. When an ignition trigger signal causes point 18 to abruptly rise to the battery supply voltage at point 14, diode 52 is forward biased and conducted charge current to capacitor 53 providing forward bias current to transistor 58 base, switching transistor 58 into a conducting state pulling the collector near ground potential. When transistor 58 conducts, a negative pulse appears at steering diode 69 enabling the gate pulse width control, simultaneously the lower side of resistor 64 is pulled low providing forward bias current to PNP transistor 62 which pulls the collector side of resistor 63 (point 68) to the battery voltage supply rail 14 through the filter made up of resistor 66 and capacitor 67 supplying similar forward bias current to transistor 58 base, holding the collector low and latched. Simultaneously, the step voltage rise at transistor collector 68 is differentiated by capacitor 90 and resistor 92 to produce a positive pulse at SCR gate 6*a* to provide the first ignition timing pulse. With both transistors 58 and 62 conducting, a stable latched state exists which will persist until the ignition trigger point 18 returns low. When point 18 returns low or near ground potential diode 52 is reverse biased resulting from the charge on capacitor 53 and capacitor 53 will now discharge through resistor 51 and diode 55. The discharge RC is approximately 600 microsecond which is sufficient to provide breaker point bounce inhibit, as point bounce occurs within the first few microseconds of point closure. Capacitor 59 is a filter capacitor. Universal input trigger converter 19 accepts various type of input trigger sources providing signal shaping and high noise immunity.

When the resulting positive pulse train is submitted to SCR 6 gate 6*a*, SCR 6 conducts thus placing the ignition capacitor 4 directly in parallel with the ignition coil primary 1 which produces, through ignition coil 3 pulse transformer action, high voltage on secondary coil winding 2 to fire a spark plug. When the ignition capacitor 4 has completed its discharge oscillation, the collapsing magnetic field produced at the ignition coil primary 1 submits a reverse voltage polarity commutating SCR 6 into cutoff (with high current diode 7 forward biasing to supply a recharge path to ignition capacitor 4). Capacitor 23/resistor 24 combination are a snubber to reduce voltage spikes when SCR 6 commutates.

Figure 3:
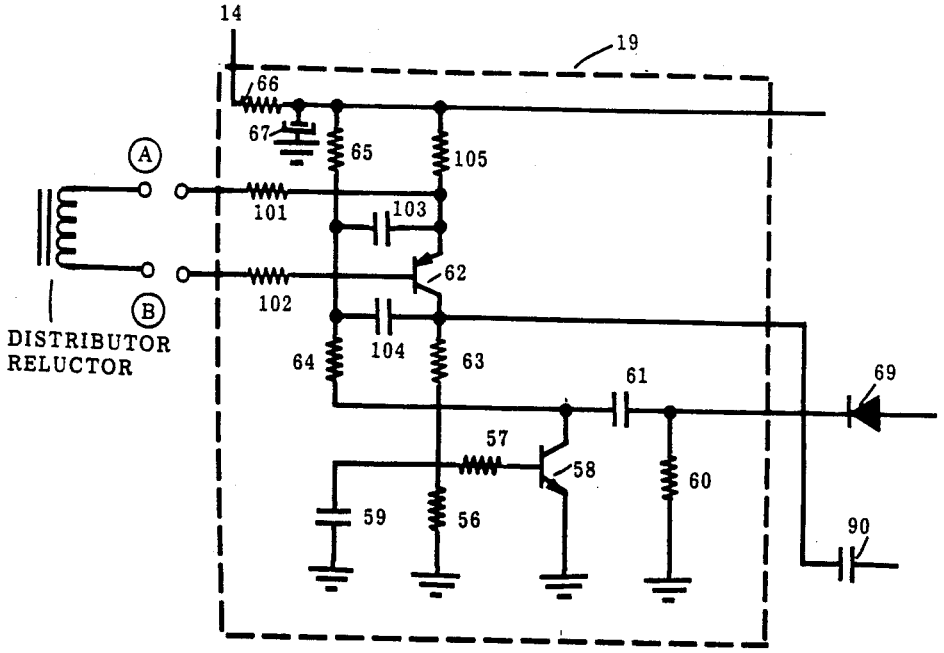
FIG. 3 is a detailed circuit drawing depicting triggering means suitable for OEM applications.

FIG. 3 depicts an input trigger which is specifically designed for OEM (original equipment manufacturing) applications, i.e. the universal input trigger circuit 19 can be modified to accept the small signal levels directly available from the distributor reluctor sensors, thus eliminating the intermediate electronic module of the OEM electronic ignition. In the modification, components 50, 51, 52, 53, 54, 54*a*, and 55 are removed while adding resistors 101, 102, and 105 and capacitors 103 and 104. The two-transistor-latch functions in the conventional manner as described with the exception that input triggering occurs at the input of PNP transistor 62. Resistors 101 and 102 provide isolation and current limiting between the reluctor sensor and transistor 62 while capacitors 103 and 104 provide voltage transient protection to transitor 62. Assuming transistors 62 and 58 are non-conducting and the reluctor voltage output is polarized with a plus voltage at terminal A and a negative voltage at terminal B with an advancing reluctor pole piece, transistor 62 will be forward biased causing transistor 62 to conduct providing the initial conditions to force the trigger circuit into a latched state. When the reluctor rotating pole piece recedes, the polarity across the reluctor reverses which reverse biases the base-emitter junction of transitor 62 forcing the input trigger circuit out of the latched mode completing the input trigger cycle.

In this way we have provided through the above described invention an improved and versatile high efficiency rapidly pulsing multiple pulse ignition supply and control system, which when used in conjunction with an energy storage capacitor and an ignition coil, provides an easily installed or retrofitable ignition system capable of providing rapid firing ignition pulses at a high power supply efficiency, and which is suitable for all internal combustion engines including diesel engines.

Since certain changes may be made in the above apparatus and method without departing appreciably from the scope of the invention, it is intended that all matter contained in the above description, or shown in the accompanying drawings shall be interpreted in an illustrative and not in a limiting sense.

While the invention may be practiced in many sets of component values, one typical set is given on the next page:

RAPID PULSED MULTIPLE PULSE IGNITION TYPICAL COMPONENT VALUE SET

| Description | Count | Part numbers as per FIG. 2. and 3. |
|---|---|---|
| | | Resistors |
| 22 .25 Watt | 1 | 66 |
| 100 | 5 | 30a, 92, 101, 102, 105 |
| 220 | 1 | 87 |
| 1K | 4 | 56, 57, 65, 86 |
| 3.3K | 4 | 36a, 36b, 51, 81 |
| 4.7K | 6 | 39a, 39b, 63, 64, 72a, 72b |
| 10K | 3 | 43, 60, 83 |
| 22K | 2 | 37a, 37b, |
| 30K | 4 | 45, 71a, 71b, 75a |
| 360K .5 Watt | 2 | 46, 75b |
| 68 1.0 Watt | 2 | 24, 24a |
| 150 1.0 Watt | 1 | 50 |
| | | Capacitors |
| .0033 uf/16 v | 5 | 35a, 35b, 80, 103, 104 |
| .01 uf/16 v | 3 | 61, 73, 90 |
| .022 uf/16 v | 2 | 79, 84 |
| .025 uf/500 v | 2 | 23, 23a |
| .1 uf/100 v | 4 | 30b, 59, 76, 89 |
| .27 uf/250 v | 1 | 53 |
| 2.0 uf/400 v | 1 | 4 |
| 150 uf/25 v | 2 | 38, 67 |
| | | Semiconductors |
| IN4004 diode | 6 | 48a, 48b, 52, 54, 54a, 55 |
| IN4148 diode | 8 | 41a, 41b, 69, 74a, 74b, 82, 91, 93, |
| IN4937 fast diode | 4 | 32a, 32b, 32c, 32d |
| IN5232B zener | 1 | 77 |
| IN5761A Diac | 1 | 44 |
| MR506 3A diode | 1 | 7 |
| MCR2150-6 SCR | 1 | 6 |
| 2N3904 | 3 | 34a, 34b, 42 |
| 2N4123 NPN | 4 | 58, 70a, 70b, 78 |
| 2N4125 PNP | 1 | 62 |
| 2N4871 UJT | 1 | 85 |
| TIP141 Power Tr. | 2 | 33a,33b |

What is claimed is:

1. In an ignition controller including a universal input trigger converter for receiving input triggers and converting said triggers to a well defined initial trigger pulse used to fire an SCR or other switching means and for triggering a gate pulse width control which enables gated clock oscillator to produce a sequence or train of pulses, said gate pulse width control comprising:

(a) bistable multivibrator with initializing capacitor;

(b) a charging RC time constant forming circuit including charge diode, resistor Rc and capacitor Ct;

(c) a discharging RC time constant forming circuit including a discharge diode, resistor Rd and same capacitor Ct;

(d) a zener reference diode;

(e) an NPN common emitter transistor;

(f) a connection to common point of Rc, Rd, and Ct which is the cathode of said zener reference diode, and anode of said zener connected to base of NPN common emitter transistor switch with the collector connected to the reset transistor base point of said bistable multivibrator, such that when said gate pulse width control receives a set input trigger, a positive going output pulse width is generated which is connected to said gate controlled oscillator through a series resistor Re and the cathode of a gate clock diode enabling said oscillator, which produces pulses at a preset rate for the duration of said gate pulse width control positive going output width duration, said duration being determined by the rate of input pulses to the gate pulse width control by the gate pulse width control charge-discharge component values of Rc, Rd, and Ct, the input enabling resistor Re in series with gate clock diode of the gated clock oscillator establishes input off-set voltage to the gated clock oscillator providing a means of controlling the gated clock oscillator start-up time.

2. The ignition controller of claim 1 further including a universal input trigger converter and gated clock oscillator for producing pulses for the duration when said controller produces its positive going output.

3. The ignition controller of claim 2 further including a capacitive discharge ignition system comprising a capacitor, a coil, and DC to DC power converter, and an SCR with diode across it, for producing high voltage ignition spark pulses when input trigger is received and said controller is producing its positive going output.

4. The ignition controller of claim 3 wherein universal input trigger converter is a universal input trigger converter.

5. A universal input trigger converter for receiving input triggers from ignition elements of IC engine, such triggers defined by a positive rising edge followed by a negative falling edge, said converter comprising:

(a) input trigger signal conditioner including input trigger load resistor, a paralleled diode-resistor combination, a signal coupling capacitor which is connected to three transient protection limiter diodes, noise filler capacitor, and resistive network to the base of an NPN latch transistor;

(b) said NPN transistor and a PNP transistor with five associated resistors forming a self latching pulse shaping amplifier;

(c) an output capacitor means and a resistor means forming negative going differentiated pulse connected to the cathode of a steering diode, such that when input trigger is received said NPN and PNP transistors are turned on and cross latched, producing a negative pulse at said steering diode to a gate pulse width control set bistable input.

6. An OEM input trigger converter for receiving trigger signals from distributor reluctor sensors, said input trigger converter comprising:

(a) input trigger signal conditioner including two input limiting and isolation resistors across the base-emitter junction of PNP transistor, two voltage transient protection capacitors across the PNP transistor, and said PNP transistor emitter load resistor;

(b) said PNP transistor and NPN transistor with five associated resistor forming a self latching pulse shaping amplifier;

(c) an output capacitor means and a resistor means forming negative going differentiated pulse connected to the cathode of a steering diode, such that when input trigger is received said PNP and NPN transistors are turned on and cross latched, producing a negative pulse at said steering diode.

7. The input trigger converter of claim 6 in combination with a gate width pulse control and gated clock oscillator for producing pulses for the duration when said control produces its positive going output.

8. The system of claim 7 further including a capacitive discharge ignition system comprising a capacitor, a coil, and DC to DC power converter, and an SCR with a diode across it, for producing high voltage ignition spark pulses when an input trigger is received by said input trigger converter and said gate width pulse control is producing its positive going output.

9. The input trigger converter of claim 6 in combination with a capacitor connected to said PNP transistor collector, wherein output of said capacitor is a positive going pulse connected to the gate of an SCR for triggering said SCR.

10. The input trigger converter of claim 9 further including capacitor discharge ignition system comprising a capacitor, a coil, a DC to DC power converter, and said SCR with diode across it, for producing a high voltage ignition spark when input trigger is received at the input trigger converter input whose output triggers said SCR.

* * * * *